US005261169A

United States Patent [19]

Williford

[11] Patent Number: 5,261,169

[45] Date of Patent: Nov. 16, 1993

[54] SYSTEM AND METHOD FOR DEODORANT DELIVERY IN FOOTWEAR

[75] Inventor: John H. Williford, Atherton, Calif.

[73] Assignee: Advanced Polymer Systems, Inc., Redwood City, Calif.

[21] Appl. No.: 776,509

[22] Filed: Oct. 11, 1991

[51] Int. Cl.[5] ..... A43B 13/38

[52] U.S. Cl. ..... 36/43; 36/44; 36/98

[58] Field of Search ..... 36/43, 44, 71, 98

[56] References Cited

U.S. PATENT DOCUMENTS

| | | | |
|---|---|---|---|
| 1,249,000 | 12/1917 | Benjamin | 36/43 |
| 2,061,911 | 11/1936 | Leindorf . | |
| 2,451,929 | 10/1948 | Dorgin | 36/44 |
| 2,560,120 | 7/1951 | Miller et al. | 36/44 |
| 2,911,973 | 11/1959 | Chieffo | 36/43 |
| 3,567,118 | 3/1971 | Shepherd | 15/104.93 |
| 4,187,622 | 2/1980 | Sung | 36/44 |
| 4,192,086 | 3/1980 | Sichak | 36/44 |
| 4,257,176 | 3/1981 | Hartung et al. | 36/44 |
| 4,461,099 | 7/1984 | Bailly | 36/44 |
| 4,517,308 | 5/1985 | Ehlenz et al. | 36/43 |
| 4,533,351 | 8/1985 | Washkuhn . | |
| 4,619,055 | 10/1986 | Davidson | 36/44 |
| 4,709,490 | 12/1987 | Föttinger et al. | 36/43 |

FOREIGN PATENT DOCUMENTS

WO86/02559 5/1986 PCT Int'l Appl. .

*Primary Examiner*—Paul T. Sewell
*Assistant Examiner*—M. D. Patterson
*Attorney, Agent, or Firm*—Townsend and Townsend

[57] ABSTRACT

An article for the pressure-actuated release of the powder composition comprises a resilient layer having a plurality of discrete reservoirs therein. Each reservoir contains an isolated quantity of an active powder composition, and usually a permeable layer covers an open aperture from the reservoir. As the article is compressed, the powder is forced outward through the permeable layer and into the surrounding environment. In a preferred example, the article is a shoe insole and the active composition is an anti-microbial powder, usually being an anti-microbial agent which is absorbed into porous particles.

22 Claims, 2 Drawing Sheets

SYSTEM AND METHOD FOR DEODORANT DELIVERY IN FOOTWEAR

BACKGROUND OF THE INVENTION

1. Field of the Invention

The present invention relates generally to articles and methods for delivering powder compositions to an enclosed environment and, more particularly, to a shoe insole structure having a plurality of reservoirs containing an active ingredient powder, where the powder can be released to the interior of a shoe by walking on the insole.

Foot odor and infection are common problems caused by microbial growth in the enclosed environment of the shoe. Moisture resulting from foot perspiration provides an ideal growth environment for both bacteria and fungus, causing odor and athlete's foot, respectively.

The inhibition of such microbial growth has been a long sought goal of the shoe industry, and numerous approaches have been proposed and tried. Commonly, activated charcoal is incorporated into a shoe insole in order to absorb odor and moisture. Although partly effective in controlling odor, the degree of moisture absorption is not sufficient to inhibit microbial growth in most cases. Thus, the odor continues to be produced and athlete's foot and other infections can occur. Moreover, the ability of the activated charcoal to absorb odor is quite limited and the effectiveness of the insole is usually short-lived.

Antimicrobial agents have also been incorporated within a shoe insole with varying degrees of success. Usually, however, the anti-microbial agents are either released too rapidly to provide for long-term effectiveness or entrapped to securely within the insole to provide for sufficient activity. The ideal system for the extended delivery of anti-microbial and deodorant agents from a shoe insole has yet to be found.

Thus, it is desirable to provide improved articles and methods for delivering deodorants and antimicrobial compositions to the shoe environment during use. The delivery of such compositions should last over numerous wearings of the shoes and should provide a generally uniform distribution of the composition throughout the entire region of the shoe as the wearer walks thereon. The articles and methods should be capable of delivering a wide variety of compositions, including anti-bacterial agents and fragrances for odor control and anti-fungal compositions for the control of athletes foot and other infections. Desirably, the articles should be sealable so that they can be stored for extended periods without substantial loss of activity prior to use.

2. Description of the Relevant Art

U.S. Pat. No. 2,560,120, discloses an insole having vertical passages which communicate with a single reservoir of a moisture absorbing agent which may be a powder. The powder is located only beneath the instep and is never released through the passages. Instead, air recirculates through the passages and the moisture absorbent material. U.S. Patent Nos. 4,187,622 and 2,911,973, each disclose the release of a foot powder through a mesh or porous layer in an insole. The insole structures, however, both include common reservoirs which will allow shifting of the foot powder away from the areas of maximum foot pressure. Thus, the foot powder will not be distributed as evenly as would be desirable. U.S. Patent Nos. 4,517,308 and 4,257,176 each disclose the incorporation of an encapsulated deodorant or perfume in an insole structure. Other structures for deodorizing footwear are described in U.S. Patent Nos. 4,533,351; 4,461,099; 2,061,911; and WO 86/02559.

SUMMARY OF THE INVENTION

According to the present invention, an article for pressure-actuated delivery of a powder composition comprises a resilient layer having a plurality of apertures formed therethrough. An impermeable layer is laminated on one face of the resilient layer to form a plurality of reservoirs in combination with apertures. The reservoirs remained open on the surface opposite to the impermeable layer, and an active powder disposed within the reservoirs may be delivered through each opening by applying pressure to the article to compress the resilient layer. Optionally, a permeable layer may be provided over the other surface of the resilient layer in order to further control the release rate of the powder from the apertures. As a further option, a protective and permeable layer may be removably laminated over the permeable layer (or directly to the resilient layer when no permeable layer is provided) in order to preserve and protect the active powder during storage.

In a preferred aspect, the article of the present invention is a shoe insole and the powder is a foot powder, typically including an anti-microbial active substance and optionally a fragrance. The resilient layer is preferably a closed-cell foamed plastic material having the reservoirs formed therein. A permeable layer is laminated to the resilient layer and covers the reservoir openings to control release of the foot powder as the insole is walked upon. Preferably, the permeable layers of woven fabric and the foot powder is able to migrate upward through the interstitial passages within the woven matrix as the resilient layer is compressed to force the foot powder upward. Optionally, the permeable layer may have openings therethrough aligned with apertures in the reservoirs to permit more rapid release of the foot powder. Usually, the permeable layer will be free from discrete openings so that the overall release rate of the foot powder is controlled by the nature and density of the weave.

In a second preferred aspect, the foot powder will comprise porous particles having the anti-microbial substance, fragrance, and optionally other active ingredients, absorbed therein. The particles are preferably substantially non-collapsible polymeric particles, each defining a network of internal pores and having the active substances absorbed within said network. The use of such a particulate delivery system is advantageous as it further controls the release rate of the active substances and acts to preserve the active substances between wearings of shoes including the insoles.

According to the method of the present invention, the powder is released from the article by pressing the resilient layer to force the powder from the reservoirs out through the apertures. By providing discrete reservoirs connected with only one or a limited number of apertures, a substantially even distribution of the powder within the article can be maintained during handling and use. Use of the single large reservoir, as discussed in the background of the present invention, is disadvantageous as it allows shifting of a powder during handling and use. Such shifting can lead to an uneven delivery of the active powder during use of the article. In the case of shoes, the insole of the present invention will be placed within the shoe in a conventional manner, typically after removal of the protective cover layer. The active foot powder will then be released each time the user wears and walks on the shoes, with the preferred powder compositions of the present invention helping preserve the active ingredients between wearings. After a large number of wearings, when the supply of the active powder becomes exhausted, the insole may be replaced within another insole of the same type to extend the life of the shoes.

DESCRIPTION OF THE SPECIFIC EMBODIMENTS

Figure 1:
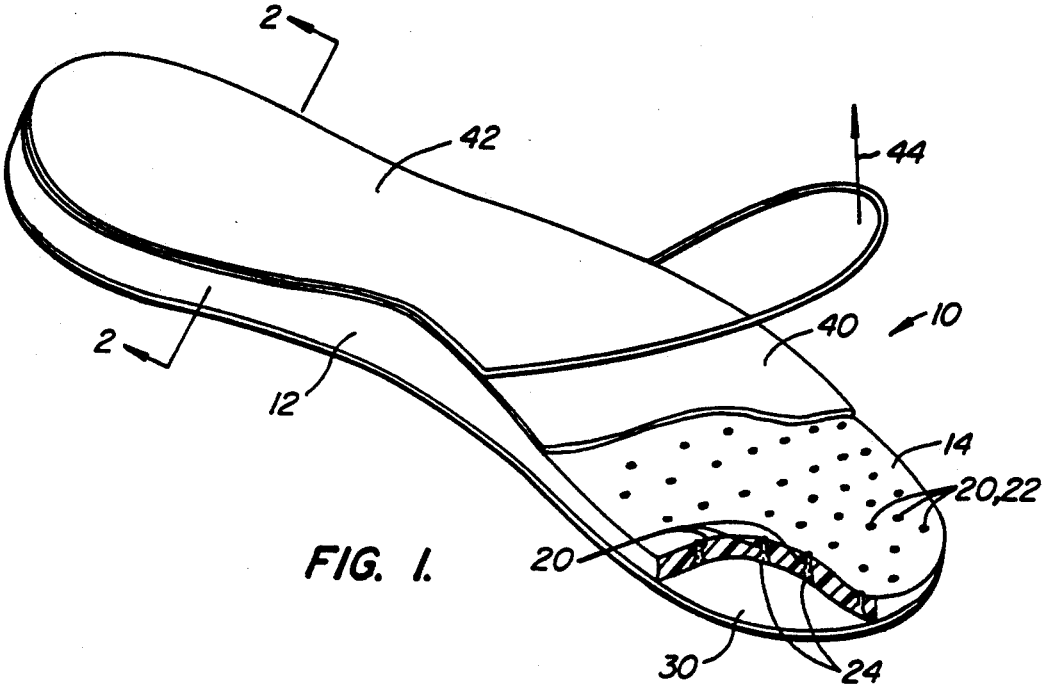
FIG. 1 is a perspective view of the shoe insole constructed in accordance with the principles of the present invention, with portions broken away.

According to the present invention, the shoe insoles and other articles comprise a resilient layer having a plurality of discrete reservoirs therein. The reservoirs are usually formed as apertures extending through the entire thickness of the resilient layer with an impermeable layer laminated to one face of the resilient layer to close the apertures on one side. An active powder, such as a foot powder in the case of insoles, is contained in the reservoirs and released from the article as the resilient layer is periodically compressed, such as by walking thereon. Usually, a permeable layer is laminated over the face of the resilient layer opposite to the impermeable layer in order to control the release rate of the powder. A removable protective layer may be formed over the permeable layer in order to seal in the active powder prior to use.

The geometry of the apertures and associated reservoirs is not critical. The apertures may be formed as cylindrical penetrations through the thickness of the resilient layer, but more usually will have an enlarged lower region for retaining the active powder and a relatively constricted upper region through which the powder is released. Most often, each reservoir will be connected to a single opening or aperture through which the active powder will be released, although in some cases it may be desirable to connect two or more openings to a single (otherwise enclosed) reservoir. It is an important aspect of the present invention, however, that a plurality of isolated reservoirs be distributed over the area of the resilient layer so that the active powder in each reservoir is prevented from shifting and accumulating at a single location or relatively few locations. Only by maintaining a substantially even distribution of the powder over the entire area of the article, can the desired uniform delivery of the present invention be achieved.

The resilient layer may be any type of material commonly used as an impact-absorbing layer in shoe insoles or other compressible articles. Particularly suitable are foam rubber insole materials, such as rubber latex foams, polyurethane latex foams, polypropylene latex foams, butyl latex foams, and the like. Particularly preferred are closed-cell foamed thermoplastics formed from a number of known thermoplastic foam materials and blends thereof, such as polyethylene, ethylene vinyl acetate copolymers, cross-linked polyethylene, acrylics, polyvinyl chloride, polystyrene and the like. Such foamed materials can be obtained as pre-formed thermoplastic sheets, or alternatively, may be molded into a desired shape and foamed by nitrogen injection by a well-known technique. The pre-formed foam materials can be thermo-molded after softening in an oven in a conventional mold cavity.

The apertures may be formed into the resilient layer during molding, thermo-molding, or may alternatively be grilled or cut into the material after the desired overall geometry has been obtained. In some cases, it may be possible to form reservoirs having a single opening entirely during molding process or by molding two halves of the resilient layers separately and laminating them together thereafter. More usually, however, apertures will first be provided through the resilient layer and the aperture openings on one side of the layer sealed by laminating an impermeable layer thereover.

The thickness of the resilient layer will depend on the nature and intended purpose of the article being produced. For insoles, the thickness of the layer will usually be in the range from about 0.05 inch to 1.0 inch, usually being from about 0.1 inch to about 0.5 inch, with the thickness varying to conform to the shape of a foot including an instep, heel, and the like. Most usually, the upper surface of the insole will be contoured to conform to the foot, while the lower surface of the sole will be substantially flat.

The impermeable layer will be a relatively thin, flexible layer which is laminated to the lower face of the resilient layer, typically using a suitable adhesive. Conveniently, the impermeable layer will be plastic film, such as polyethylene, polyvinylchlorine, or the like. The thickness of the impermeable layer will be sufficient to isolate the internal environment of the reservoirs, typically being thick enough to substantially inhibit oxygen intrusion into the reservoir. Thickness will usually be less than about 0.1 inch, usually being the range from about 1 to 50 mils, more usually being from 3 to 25 mils.

The permeable layer will be laminated to the face of the resilient layer opposite to the impermeable layer and will have intersticial passages therethrough which are sufficiently large to permit the migration of the active powder which is released as pressure is applied to the resilient layer. Conveniently, the permeable layer will be a woven fabric, usually being a fabric woven from synthetic fibers which do not retain moisture, such as polypropylene, polyethylene, nylon, and the like. Natural fibers, such as cotton, may also find use although they are generally less preferred.

The active powder which is held inside the reservoirs within the resilient layer will include an antimicrobial composition such as an anti-bacterial agent to control odor and/or an anti-fungal agent to control infection, such as athlete's foot. Such antimicrobial agents are commercially available in powder form from a variety of commercial suppliers.

In the preferred embodiment, the anti-microbial agent(s) and other active ingredient(s) will be absorbed into porous particles to form a dry, free-flowing powder which can be incorporated within the reservoirs. The use of porous particles for absorbing the active ingredients is advantageous in several respects. First, the particles allow the use of liquid anti-microbial and other agents which would otherwise be difficult to incorporate within the reservoirs of the present invention. Second, the porous particles facilitate the combination of two or more active ingredients, such as separate antibacterial and anti-fungal agents, even when the active ingredients might otherwise be incompatible if directly mixed. Third, the use of the porous particles helps to preserve the active ingredients and provides for a second level of controlled release. That is, a release of the active ingredient to the environment requires first that the particles be expelled from the reservoirs and migrate upward through the permeable layer, and second, that the active ingredients be released from the particles. Such further control over the release rate can further extend the efficacy of the anti-microbial agents of the present invention.

Particularly preferred for its particles for use in the present invention are substantially rigid, open-pore particles which are chemically and biologically inert and hold an antimicrobial and optional other active substance(s) as an impregnant inside the pores by capillary forces. The pores are interconnected and open to the particle surface so that substantially full communication is provided between the internal pore space and the exterior of the particle.

The particles are generally spherical in shape, having been prepared by suspension polymerization as described in more detail hereinafter. The particle size or diameter may vary widely, usually being in the range of about 5 to about 100 microns in diameter, preferably being from about 10 to about 40 microns in diameter. Particles within the latter size range are aesthetically appealing and impart a smooth feel to the touch.

The pore size and other dimensions of the particles may vary widely, with optimum dimensions depending on the chemical characteristics of the polymers used as well as the diffusive characteristics of the antimicrobial impregnant. Different systems will thus call for different optimum ranges of pore volume distribution to obtain the most desirable properties for the overall formulation. In general, however, the best results are obtained with total pore volumes ranging from about 0.01 to about 4.0 cc/g, preferably from about 0.1 to about 2.0 cc/g; surface areas ranging from about 1 to about 500 $m^2/g$, preferably from about 20 to about 200 $m^2/g$; and the average pore diameters ranging from about 0.001 to about 3.0 micron, preferably from abut 0.003 to about 1.0 micron. Following conventional methods of measuring and expressing pore sizes, the pore diameters are calculated from the measurement of the surface area by B. E. T. nitrogen analysis (Bruanauer et al. (1938) J. Am. Chem. Soc. 60:309-316) and from the measurement of the pore volumes by the mercury intrusion method.

The particles are conveniently formed as microspheres by suspension polymerization in a liquid-liquid system. In general, a solution containing desired monomers, a polymerization catalyst (if used), and an inert fluid (porogen) is formed in a first liquid phase, where the porogen is miscible with the first fluid phase, but immiscible with a second liquid phase. The solution is then suspended in the second liquid phase. In the case of water-insoluble monomers, the first liquid phase will usually be an organic solvent capable of solvating the monomers but which is immiscible with water. The second liquid phase will be water. In the case of water-soluble monomers, the first liquid phase will be aqueous while the second liquid phase will be a hydrophobic organic solvent.

Once the suspension is established with discrete droplets or a desired size, polymerization is effected (typically by activating the reactants by either increased temperature or irradiation). After polymerization is complete, the resulting beads are recovered from the suspension. The beads at this point are substantially rigid porous structures, the polymer having formed around the inert fluid thereby forming the pore network. The liquid has accordingly served as a porogen, or pore-forming agent, and occupies the pores of the formed beads. Suitable porogen fluids will be described in more detail hereinafter.

In certain cases, the antimicrobial or other active substance (typically dissolved in a suitable solvent) may act as the porogen and the porous beads recovered from the suspension after polymerization are, after washing and drying, substantially ready for use. In these cases, bead formation and incorporation of the antimicrobial substance are performed in a single step. The procedure may thus be termed a one-step procedure.

The antimicrobial compositions of the present invention may also be prepared by a two-step suspension polymerization procedure which involves placing the antimicrobial impregnant inside the pores of preformed dry porous polymer beads. The product is thus prepared in two steps performed in sequence, comprising first, polymerization procedure which involves placing the antimicrobial impregnant inside the pores of preformed dry porous polymer beads. The product is thus prepared in two steps performed in sequence, comprising first, polymerization with a substitute porogen, which is then removed, followed by replacement with the desired active antimicrobial substance. Hence, the porogen and active substance are distinct components in this two-step process.

Materials suitable as porogens, including both antimicrobial porogens and substitute porogens for the two-step procedure, will be substances which meet the following four criteria listed below:

1) They are either wholly miscible with the monomer mixture or capable of being made fully miscible by the addition of a minor amount of a solvent which is non-miscible with the second liquid phase;

2) They are immiscible with the second liquid phase, or at most slightly soluble;

3) They are inert with respect to the monomers, and stable when in contact with any polymerization catalyst used and when subjected to any conditions needed to induce polymerization (such as temperature and radiation); and 4) They are normally liquids or have melting points below the polymerization temperature. Solids can frequently be converted to liquid form by being dissolved in a solvent or by forming eutectic mixtures.

Preferred among these substances suitable as substitute porogens are hydrocarbons, particularly inert, non-polar organic solvents. Some of the most convenient examples are alkanes, cyclalkanes, and aromatics. Examples of such solvents are alkanes of 5 to 12 carbon atoms, straight or branched chain, cycloalkanes of 5 to 8 carbon atoms, benzene, and alkyl-substituted such as toluene and the xylenes. Porogens of other types include $C_4$-$C_{20}$ alcohols perfluoro polyethers, and silicone oils. Examples of silicone oils are poly-dimethylcyclosiloxane, hexamethyldisiloxane, cyclomethicone, dimethicone, amodimethicone, trimethylsilylamodimethicone, polysiloxane-polyalkyl copoloymers (such as stearyl dimethicone and cetyl dimethicone), dialkoxydimethylpolysiloxanes (such as stearoxy dimethicone), polyquaternium 21, dimethicone propyl PG-Betaine, dimethicone copolyol and cetyl dimethicone copolyol. Removal of the porogen may be effected by solvent extraction, evaporation, or similar conventional operations.

The two-step process is often preferable in that it permits the removal of unwanted species formed within the polymerized structures prior to incorporation of the impregnant. Examples of unwanted species include unreacted monomers, residual catalysts, and surface active agents and/or dispersants remaining on the sphere surfaces. A further advantage of the two-step technique is that it permits one to select the amount and type of porogen as a means of controlling the pore characteristics of the finished bead. One is thus no longer bound by the limitations of the impregnant as it affects the structure of the bead itself. This permits partial, rather than full, filling of the pores with the porogen, and further control of the pore size and distribution by selection among swelling and non-swelling porogens.

Extraction of a substitute porogen and its replacement with (i.e., impregnation of the dry bead with) the impregnant in the two-step procedure may be effected in a variety of ways, depending on the chemical nature of the porogen and its behavior in combination with that of the other species present. The beads are first recovered from the suspension by filtration, preferably using vacuum filtration apparatus (such as a Buchner funnel). The beads are then washed with an appropriate solvent to remove organic species not bound to the polymer, including surfactants having deposited on the bead surfaces from the aqueous phase, unreacted monomers and residual catalysts, and the porogen itself. An example of such a solvent is isopropanol, either alone or in aqueous solution. Once washing is complete, the solvent itself is removed by drying, preferably in a vacuum.

In certain cases, an alternative method of extraction may be used—i.e., where the porogen, unreacted monomer and water will form an azeotrope. In these cases, steam distillation is an effective way of extracting porogen from the beads. This again may be followed by drying under vacuum.

Once the beads are rendered dry and free of the substitute porogen and any unwanted organic material, they may be impregnated with the desired impregnant according to conventional techniques. The most convenient such technique is contact absorption. Solid active ingredients are first dissolved in a solvent, such as, for example, isopropanol, and the resulting solution is absorbed by the beads. The solvent may either be retained in the finished product or removed by conventional means such as evaporation or extraction using a further solvent. For those solid ingredients having limited solubility in a particular solvent, high contents in the finished bead can be attained by repeated absorptions each followed by solvent removal.

The polymerization process and the various parameters and process conditions involved in the polymerization can be selected and adjusted as a means of controlling the pore characteristics and consequently the capacity and release characteristics of the ultimate product. For example, proper selection of the crosslinking means, the amount and type of crosslinking agent, and the amount and type of porogen are means of attaining such control. Certain polymerization conditions may also be varied to such effect, including temperature, degree of radiation where used, degree of agitation and any other factors affecting the rate of the polymerization reaction.

Crosslinking in the polymer formation is a major means of pore size control. Monomers which may be polymerized to produce crosslinked polymer beads in accordance with the present invention include polyethylenically unsaturated monomers, i.e., those having at least two sites of unsaturation, and monoethylenically unsaturated monomers in combination with one or more polyethylenically unsaturated monomers. In the latter case, the percentage of crosslinking may be controlled by balancing the relative amounts of monoethylenically unsaturated monomer and polyethylenically unsaturated monomer. The polymer beads of the present invention will have greater than 10% crosslinking, preferably from about 10% to about 80% crosslinking, and most preferably from about 20% to about 60% crosslinking. The percentage crosslinking is defined as the weight of polyethylenically unsaturated monomer or monomers divided by the total weight of monomer, including both polyethylenically unsaturated and monoethylenically unsaturated monomers.

Monoethylenically unsaturated monomers suitable for preparing polymer beads for the polymer delivery system include ethylene, propylene, isobutylene, disobutylene, styrene, vinyl pyridine ethylvinylbenzene, vinyltoluene, and dicyclopentadiene; esters of acrylic and methacrylic acid, including the methyl, ethyl, propyl, isopropyl, butyl, sec-butyl, tert-butyl, amyl, hexyl, octyl, ethylhexyl, decyl, dodecyl, cyclohexyl, isobornyl, phenyl, benzyl, alkylphenyl, ethoxymethyl, ethoxyethyl, ethoxypropyl, propoxymethyl, propoxyethyl, propoxypropyl, ethoxyphenyl, ethoxybenzyl, and ethoxycyclohexyl esters; vinyl esters, including vinyl acetate, vinyl propionate, vinyl butyrate and vinyl laurate; vinyl ketones, including vinyl methyl ketone, vinyl ethyl ketone, vinyl isopropyl ketone, and methyl isopropenyl ketone; vinyl ethers, including vinyl methyl ether, vinyl ethyl ether, vinyl propyl ether, and vinyl isobutyl ether; and the like. Polyethylenically unsaturated monomers which ordinarily act as though they have only one unsaturated group, such as isopropene, butadiene and chloroprene, may be used as part of the monoethylenically unsaturated monomer content.

Usually, the monoethylenically unsaturated monomer will be present at no more than about 90% by weight of the monomer mixture, usually being from about 20% to 90% by weight of the monomer mixture and more usually being from about 40% to 80% by weight, with the polyethylenically unsaturated monomer forming the remainder of the mixture.

Polyethylenically unsaturated crosslinking monomers suitable for preparing such polymer beads include diallyl phthalate, ethylene glycol diacrylate, ethylene glycol dimethacrylate, trimethylolpropanetrimethacrylate, divinylsulfone; polyvinyl and polyallyl ethers of ethylene glycol, of glycerol, of pentaerythritol, of diethyleneglycol, of monothio- and dithio-derivatives of glycols, and of resorcinol; divinylketone, divinylsulfide, allyl acrylate, diallyl maleate, diallyl fumarate, diallyl succinate, diallyl carbonate, diallyl malonate, diallyl oxalate, diallyl adipate, diallyl sebacate, divinyl sebacate, diallyl tartrate, diallyl silicate, triallyl tricarballylate, triallyl aconitate, triallyl citrate, triallyl phosphate, divinyl naphthalene, divinylbenzene, trivinylbenzene; alkyldivinylbenzenes having from 1 to 4 alkyl groups of 1 to 2 carbon atoms substitute on the benzene nucleus; alkyltrivinylbenzenes having 1 to 3 alkyl groups of 1 to 2 carbon atoms substitute on the benzene nucleus; trivinylnaphthalenes, and polyvinylanthracenes.

In some cases it will be desirable to employ a cationic polymer bead delivery system prepared as described in copending application serial number 07/272,600, the disclosure of which is incorporated herein by reference. The individual beads of such a system possess a positive charge under the conditions of use which promotes bead adhesion to keratinic materials, such as human skin and hair. The beads are prepared from monomers possessing protonatable functionalities, such as pyridine or ammonium. A positive charge is imparted by acid washing the beads, where such wash may be performed before or after incorporation of the antimicrobial active ingredient.

Preferred polymer delivery systems of the present invention are formed by the copolymerization of styrene and divinylbenzene, vinyl stearate and divinylbenzene, or methylmethacrylate and ethylene glycol dimethacrylate. Particularly preferred is the styrenedivinylbenzene polymeric bead which consists essentially of a hydrocarbon backbone with benzene rings and which is substantially completely free from reactive groups. Preferred cationic bead delivery systems are formed by the copolymerization of 4-vinylpyridine and ethylene glycol dimethacrylate; 4-vinylpyridine and divinylbenzene; N,N-diethylaminoethyl methacrylate and ethylene glycol dimethacrylate terpolymer; methylmethacrylate and ethylene glycol dimethacrylate terpolymer; and N,N-diethylaminoethyl methacrylate and divinyl benzene.

Once the microspheres are formed and dried, they may be impregnated with the anti-microbial or other active substance by contact absorption. As an option, the impregnant may be used in the form of a solution in a suitable organic solvent for purposes of decreasing viscosity and facilitating absorption. Examples of such solvents are liquid petrolatum, ether, petroleum ether, alcohols including methanol, ethanol and higher alcohols, aromatics including benzene and toluene, alkanes including pentane, hexane and heptane, ketones including acetone and methyl ethyl ketone, chlorinated hydrocarbons including chloroform, carbon tetrachloride, methylene chloride and ethylene dichloride, acetates including ethyl acetate, and oils including isopropyl myristate, diisopropyl adipate and mineral oil. After absorption of the solution, the solvent can be evaporated or, if desired, retained inside the pores together with the impregnant. Where cationic functionality is desired, such carriers, lubricants, etc. must be substantially neutral, or at most slightly acidic or basic (i.e., they are incapable of neutralizing the surface charge).

Moreover, other formulating materials, such as fragrances, colors, antioxidants, masking agents, and perfumes, can also be present, and will be incorporated into and onto the beads together with the antimicrobial impregnant(s) and any other materials present.

The impregnant, whether it be pure active antimicrobial substance, a mixture of active antimicrobial substances or a solution of active antimicrobial substance, will generally comprise between approximately 5% and approximately 65% of the total weight of the impregnated beads. When the active substance is particularly potent, it will generally be in the form of a dilute solution, and the weight percent of the active substance itself may range as low as 0.01% based on the total weight or the impregnated beads.

Antimicrobial substances which may be incorporated in the polymeric bead delivery system of the present invention include virtually all antimicrobial agents which are liquid or may be solubilized in a suitable solvent, e.g., aqueous or organic. Specific classes of antimicrobial substances include antibacterial agents (bacteriostats), antifungal agents (fungostats), antiseptics, antiinfectives, and the like. Specific examples of each class of substance follow.

Suitable antimicrobials having antibacterial, antifungal and antiamebic activity include hydroxyquinolones, such as chinosol (8-hydroxyquinolone sulfate), Chlorquinaldol, chloroquinol (halquinol), and floraquin (iodoquinol); cationic surface active agents, such as benzalkonium chloride, centrimide, chlorhexidine, salicylanilide, iodine, and polyvinylpyrolidinone-iodine complex; certain dyes, such as gentian violet, and brilliant green; mercury derivatives, such as thimerosol, merbromin, and basic phenyl mercuric nitrates. Suitable broad range antiseptics and antiinfective agents include phenol, hexachlorophene, resorcinol, 4-chloro-m-cresol, dichlorobenzene, boric acid, zinc oxide, zinc peroxide, zinc p-phenolsulfonate, and zinc sterate. Antibacterial agents particularly suitable as deodorants, include 3,3',4', 5-tetrachlorosalicylanilide (Irgasan BS200); N-(4-chlorophenyl-N'-[4-chloro-3-(trifluoroethyl)phenyl]-urea (Irgasan CF3, cloflucarban); 5-chloro-2-(2,4-dichlorophenoxyl)phenol (Irgasan CH3635, triclosan); and 3,4,4'-trichlorocarbanilide (triclocarban), and Grillocin.

Antimicrobial substances may be incorporated in the polymer bead delivery system of the present invention individually or, more typically, will be combined with other active ingredients to achieve a desired antimicrobial effect. The antimicrobial substance(s) may be dissolved in a suitable liquid, usually an alcohol, esters, or other organic solvent, or used without dilution, depending on the physical characteristics of the substance(s) and desired strength of the antimicrobial composition.

Figure 2:
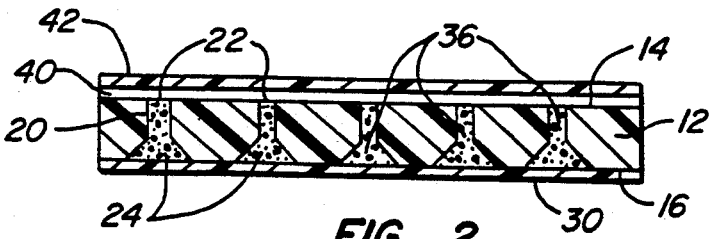
FIG. 2 is a cross-sectional view taken along line 2—2 of FIG. 1.

Referring now to FIGS. 1 and 2, a shoe insole 10 having a structure in accordance with the principles of the present invention includes a resilient layer 12 having an upper face 14 and lower face 16. The resilient layer 12 will be molded or otherwise formed to conform to the shape of a foot and may be composed of a foam rubber or closed-cell foamed plastic as described hereinabove. The resilient layer 14 includes a plurality of apertures 20 formed therethrough, with each aperture having an opening 22 in the upper face 14 and an opening 24 in the lower face 16. The lower portion of each aperture 20 is enlarged while the upper portion is relatively constricted so that the upper openings 22 are substantially smaller than the lower openings 24.

The lower openings 24 of apertures 20 are sealed by an impermeable layer 30 which is laminated to the lower face 16 of resilient layer 12. In this way, reservoirs are defined having the relatively large volume in their lower portions adjacent the impermeable layer 30 in a relatively small volume in the upper region adjacent the upper surface 14.

An active powder composition 36 is disposed within each of the apertures (reservoirs) 20. Conveniently, the active powders 36 may be inserted prior to laminating the impermeable layer 30. Once sealed, however, the only port or orifice available for release of the powders will be the upper openings 22.

A permeable layer 40, typically a woven layer as described above, is laminated to the upper surface 14 of the resilient layer 12. The permeable layer 40 includes interstitial pores which are sufficiently large to allow migration of the powder 36 upward therethrough as pressure is periodically applied to the insole 10 by the wearer's weight while walking or running.

A protective cover layer 42 may be removably laminated over the upper surface of permeable layer 40. The cover layer 42 serves to seal the apertures (reservoirs) to help preserve the active substances during storage. The protective layer 42 may be removed by pealing upward as indicated by arrow 44 in FIG. 1.

Figure 3:
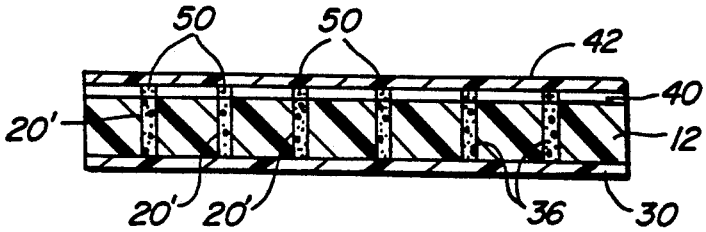
FIG. 3 is an alternate cross-sectional view similar to that of FIG. 2.

An alternate structure for the apertures in resilient layer 12 is illustrated in FIG. 3. Instead of having the enlarged lower portions, apertures 20' are cylindrical and have substantially constant diameters over their entire length. The second modification of the structure of FIG. 3 is found in permeable layer 40 where openings or ports 50 are formed through the woven fabric material and aligned with the apertures 20'. Such openings 50 will be provided when it is desired to substantially increase the release rate of the powder 36 from within the apertures 20 prime. Impermeable layer 30 and protective layer 42 are substantially the same as described in FIG. 1.

Figure 4:
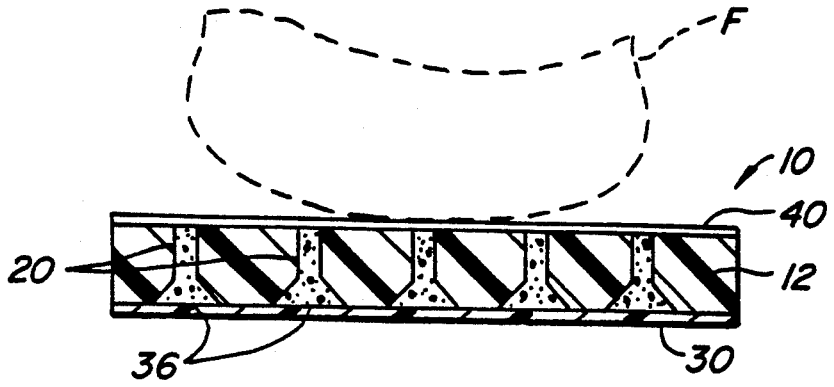
FIGS. 4–6 illustrate the method of the present invention in delivering a foot powder to the interior of the shoe.
Figure 5:
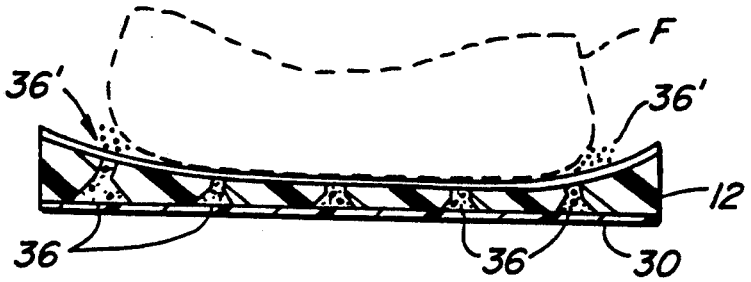
Figure 6:
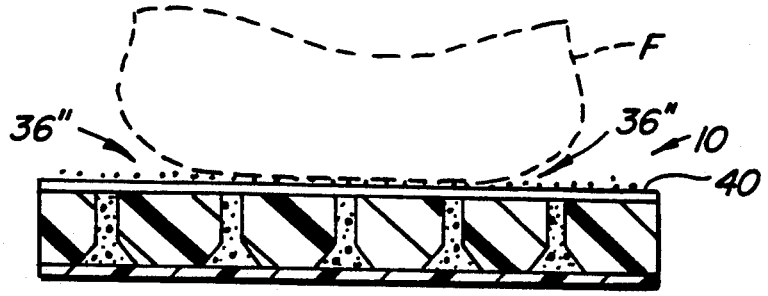

Referring now to FIGS. 4–6, the method of the present invention will be described. In FIG. 4, insole 10 is shown with the apertures (reservoirs) 20 substantially filled with active powder 36. The protective layer 42 (FIGS. 1 and 2) has been removed and the insole placed inside a shoe (not shown). The users foot F (shown in broken line) is then placed in the shoe so that it lies adjacent the permeable layer 40. FIG. 4 illustrates the situation where the foot F is applying little or no pressure onto the insole 10 so that there is no compression of the resilient layer 12.

As the user walks or runs, the foot F will periodically apply a downward pressure on the insole 10 so that the resilient layer 12 becomes compressed, as illustrated in FIG. 5. As a result of such compression, the apertures 20 (receptacles) become compressed forcing the powder 36 to migrate upward through the permeable layer 40 so that a portion of the powder 36' becomes released in the area surrounding the foot F.

As the wearer continues to walk, the foot F is lifted off of the insole 10 so that the resilient layer 12 assumes its original, expanded configuration, as illustrated in FIG. 6. A layer of powder 36", however, has now been released on the surface of the permeable layer 40 and becomes distributed over the entire area beneath the foot F. Such a periodic release of the small portion of the powder 36 will continue every time the user steps down into the insole 10 so that a continuous supply of the anti-microbial powder is introduced to the shoe. When the powder is incorporated in porous particles as described above, the active ingredients will be slowly released from the porous particles into the interior of the shoe over an extended period.

Although the foregoing invention has been described in detail for purposes of clarity of understanding, it will be obvious that certain modifications may be practiced within the scope of the appended claims.

What is claimed is:

1. A laminate structure for delivery of a powder composition, said structure comprising:

a resilient layer having a plurality of apertures formed therethrough;

an impermeable layer laminated over one side of the resilient layer to form a plurality of isolated reservoirs in combination with the apertures; and discrete portions of the powder composition disposed in at least some of the reservoirs, whereby compression of the resilient layer releases discrete quantities of the powder through the apertures.

2. A laminate structure as in claim 1, further comprising a permeable layer laminated to the other side of the resilient layer, wherein said permeable layer has interstitial passages which permit migration of said powder through said permeable layer.

3. A laminate structure as in claim 2, further comprising a removable impermeable layer laminated to the exposed side of the permeable layer, whereby the powder may be sealed in the reservoirs prior to use.

4. A laminate structure as in claim 1, wherein the powder composition comprises porous particles having an active substance absorbed therein.

5. A laminate structure as in claim 1, wherein the apertures include an enlarged region near the impermeable layer and a constricted region away from the imperemeable layer.

6. An insole for delivery of a foot powder, said insole comprising:

a resilient layer having an upper side, a lower side, and a plurality of isolated reservoirs with openings to the upper side only, wherein the resilient layer comprises a closed-cell foamed plastic material;

discrete portions of the foot powder composition disposed in at least some of the reservoirs; and a permeable layer laminated over the upper side of the resilient layer, wherein said permeable layer has interstitial passages which permit migration of the foot powder upon compression of the resilient layer by the downward pressure of a foot.

7. An insole as in claim 6, further comprising a removable impermeable layer laminated to an exposed side of the permeable layer, whereby the powder may be sealed in the reservoirs prior to use.

8. An insole as in claim 6, wherein the closed-cell foamed plasticmaterial is selected from the group consisting of polyethylene, ethylene vinylacetate copolymers, cross-linked polyethylene, acrylics, polyvinyl chloride, and polystyrene.

9. An insole as in claim 6, wherein the resilient layer is a laminated structure including a closed-cell foamed plastic layer having apertures therethrough and an impermeable layer laminated to one side of the foamed plastic layer to close the apertures and define the reservoirs.

10. An insole as in claim 6, wherein the permeable layer comprises a woven fabric layer.

11. An insole as in claim 10, wherein the fabric is woven from a material selected from the group consisting of polypropylene, polyethylene, and nylon.

12. An insole as in claim 11, wherein the foot powder comprises porous particles having an active ingredient absorbed therein.

13. An insole as in claim 12, wherein the porous particles are substantially non-collapsible polymeric particles, each defining a network of internal pores and having an antimicrobial substance within said network of internal pores.

14. An insole as in claim 13, wherein the porous particles further include a fragrance ingredient within said network of internal pores.

15. A method for delivering a powder by compression of an article, said method comprising compressing a laminate article to release a dose of powder from the article through apertures formed in a resilient layer of the laminate article, wherein the powder is retained in isolated reservoirs within the resilient layer, wherein each reservoir is connected to only one aperture.

16. A method as in claim 15, further comprising removing an impermeable layer from one side of the resilient layer prior to open the apertures compressing said resilient layer.

17. A method as in claim 15, wherein the powder is a deodorant powder which is delivered to the interior of a shoe by pressure from a foot during walking or running.

18. A method for deodorizing a shoe during use, said method comprising:

placing an insole within the shoe, wherein said insole comprises:

(i) a resilient layer, having an upper side, a lower side, and a plurality of isolated reservoirs with openings to the upper side only, wherein the resilient layer comprises a closed-cell foamed plastic material;

(ii) discrete portions of a deodorant powder disposed in at least some of the reservoirs; and (iii) a permeable layer laminated over the upper side of the resilient layer; and walking with the shoe, whereby foot pressure compresses the resilient layer to cause the deodorant powder to migrate upward from the reservoirs through interstitial passages in the permeable layer to the foot.

19. A method as in claim 18, removing a protective impermeable layer from the permeable layer prior to placing the insole within the shoe.

20. A method as in claim 18, wherein the deodorant powder comprises porous particles having an active ingredient absorbed therein.

21. A method as in claim 20, wherein the porous particles are substantially non-collapsible polymeric particles, each defining a network of internal pores and having an antimicrobial substance within said network of internal pores.

22. A method as in claim 21, wherein the porous particles further include a fragrance ingredient within said network of internal pores.

* * * * *